US007622231B2

(12) United States Patent
McGuire et al.

(10) Patent No.: US 7,622,231 B2
(45) Date of Patent: Nov. 24, 2009

(54) IMAGING MEMBERS CONTAINING INTERMIXED POLYMER CHARGE TRANSPORT COMPONENT LAYER

(75) Inventors: Gregory McGuire, Oakville (CA); Jennifer A. Coggan, Cambridge (CA); Johann Junginger, Toronto (CA); Nan-Xing Hu, Oakville (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 507 days.

(21) Appl. No.: 11/512,892

(22) Filed: Aug. 30, 2006

(65) Prior Publication Data

US 2008/0057426 A1 Mar. 6, 2008

(51) Int. Cl.
*G03G 5/047* (2006.01)

(52) U.S. Cl. ..... 430/58.8; 430/58.75; 430/59.4; 430/59.5; 430/66; 430/970

(58) Field of Classification Search ..... 430/58.8, 430/58.75, 970, 59.4, 59.5, 66
See application file for complete search history.

(56) References Cited

U.S. PATENT DOCUMENTS

| | | | | |
|---|---|---|---|---|
| 4,265,990 | A | 5/1981 | Stolka et al. | |
| 4,464,450 | A | 8/1984 | Teuscher | |
| 4,587,189 | A | 5/1986 | Hor et al. | |
| 4,784,928 | A | 11/1988 | Kan et al. | |
| 4,921,769 | A | 5/1990 | Yuh et al. | |
| 4,921,773 | A | 5/1990 | Melnyk et al. | |
| 5,055,366 | A | 10/1991 | Yu et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,068,960 | A * | 5/2000 | Pai et al. | 430/133 |
| 2005/0136349 | A1* | 6/2005 | Mishra et al. | 430/58.05 |
| 2007/0092817 | A1* | 4/2007 | McGuire et al. | 430/66 |

FOREIGN PATENT DOCUMENTS

| | | | |
|---|---|---|---|
| JP | 2002174911 A | * | 6/2002 |
| JP | 2003021921 A | * | 1/2003 |
| JP | 2003316035 A | * | 11/2003 |

OTHER PUBLICATIONS

English language machine translation of JP 2002-174911 (Jun. 2002).*
English language machine translation of JP 2003-316035 (Nov. 2003).*
English language machine translation of JP 2003-021921 (Jan. 2003).*
English language machine translation of JP 10-020519 (Jan. 1998).*
Jin Wu et al., U.S. Appl. No. 11/126,664 on Photoconductive Members, filed May 11, 2005.
Jin Wu et al., U.S. Appl. No. 11/193,242 on Polytetrafluoroethylene-doped Photoreceptor Layer Having Polyol Ester Lubricants, filed Jul. 28, 2005.
Jin Wu et al., U.S. Appl. No. 11/193,541 on Photoreceptor Layer Having Solid and Liquid Lubricants, filed Jul. 28, 2005.
Jin Wu et al., U.S. Appl. No. 11/193,672 on Photoreceptor Layer Having Polyphenyl Ether Lubricants, filed Jul. 28, 2005.
Jin Wu et al., U.S. Appl. No. 11/193,241 on Photoreceptor Layer Having Dialkyldithiophosphate Lubricant, filed Jul. 28, 2005.
Jin Wu et al., U.S. Appl. No. 11/193,129 on Photoreceptor Layer Having Phosphate-based Lubricant, filed Jul. 28, 2005.
Jin Wu et al., U.S. Appl. No. 11/193,754 on Photoreceptor Layer Having Antioxidant Lubricant Additives, filed Jul. 28, 2005.
Gregory Mcguire et al., U.S. Appl. No. 11/257,668 on Imaging Member, filed Oct. 25, 2005.

* cited by examiner

*Primary Examiner*—Christopher RoDee
(74) *Attorney, Agent, or Firm*—E. O. Palazzo

(57) ABSTRACT

A photoconductor containing a photogenerating layer, at least one charge transport layer, and a layer in contact with the charge transport layer comprised of a suitable polymer, and wherein the charge transport layer comprises molecules of the formula/structure

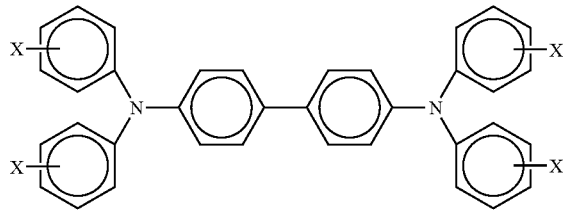

wherein X represents alkyl.

24 Claims, No Drawings

IMAGING MEMBERS CONTAINING INTERMIXED POLYMER CHARGE TRANSPORT COMPONENT LAYER

CROSS REFERENCE TO COPENDING APPLICATIONS

U.S. application Ser. No. 11/126,664, filed May 11, 2005, now U.S. Pat. No. 7,348,114, entitled Photoconductive Members; U.S. application Ser. No. 11/193,242, filed Jul. 28, 2005, now U.S. Pat. 7,468,208, entitled Polytetrafluoroethylene-doped Photoreceptor Layer Having Polyol Ester Lubricants; U.S. application Ser. No. 11/193,541, filed Jul. 28, 2005, now U.S. Pat. No. 7,527,902 entitled Photoreceptor Layer Having Solid and Liquid Lubricants; U.S. application Ser. No. 11/193,672, filed Jul. 28, 2005, now U.S. Pat. No. 7,427,440, entitled Photoreceptor Layer Having Polyphenyl Ether Lubricant; U.S. application Ser. No. 11/193,241, filed Jul. 28, 2005, now U.S. Pat. No. 7,368,210entitled Photoreceptor Layer Having Dialkyldithiophosphate Lubricant; U.S. Application Ser. No. 11/193,129, filed Jul. 28, 2005, U.S. Publication No. 20070026328, entitled Photoreceptor Layer having Phosphate-based Lubricant; and U.S. application Ser. No. 11/193,754, filed Jul. 28, 2005, U.S. Publication No. 20070026333, entitled Photoreceptor Layer Having Antioxidant Lubricant Additives. The disclosures of each of the above copending applications are totally incorporated herein by reference in their entireties.

There is illustrated in copending application U.S. application Ser. No. 11/257,668, U.S. Publication No. 20070092817, filed Oct. 25, 2005, entitled Imaging Member, the disclosure of which is totally incorporated herein by reference, a method for forming an imaging member comprising (a) providing a layer comprising a charge transport material; and (b) depositing a flowable, high viscosity overcoat composition over the layer comprising the charge transport material.

A number of the components and amounts thereof of the above copending applications, such as the supporting substrates, resin binders, photogenerating layer components, antioxidants, hole blocking layer components, adhesive layer components, thicknesses of the layers, number of layers, and the like, may be selected for the members of the present disclosure in embodiments thereof.

BACKGROUND

This disclosure is generally directed to layered imaging members, photoreceptors, photoconductors, and the like. More specifically, the present disclosure is directed to rigid or drum photoconductors, and to multilayered flexible, belt imaging members, or devices comprised of an optional supporting medium like a substrate, a photogenerating layer, a charge transport layer, and a polymer coating layer, an optional adhesive layer, and an optional hole blocking or undercoat layer. The photoreceptors illustrated herein, in embodiments, have excellent wear resistance; extended lifetimes; provide for the elimination or minimization of imaging member scratches on the surface layer or layers of the member, and which scratches can result in undesirable print failures where, for example, the scratches are visible on the final prints generated; permit excellent electrical properties; minimum cycle up after extended electrical cycling, such as 10,000 simulated cycles; increased resistance to running deletion, know as LCM; and mechanical robustness. Additionally, in embodiments the imaging or photoconductive members disclosed herein possess excellent, and in a number of instances low $V_r$ (residual potential), and the substantial prevention of $V_r$ cycle up when appropriate; high sensitivity; low acceptable image ghosting characteristics; and desirable toner cleanability.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the photoconductors disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging or photoconductive members disclosed are in embodiments sensitive in the wavelength region of, for example, from about 400 to about 900 nanometers, and in particular from about 650 to about 850 nanometers, thus diode lasers can be selected as the light source.

REFERENCES

U.S. Pat. No. 5,055,366, the disclosure of which is totally incorporated herein by reference, discloses an overcoat layer containing a film forming binder material or polymer blend doped with a charge transport compound. The charge transport compound is present in an amount of less than about 10 percent by weight. Alternatively, the overcoat layer may contain a single component hole transporting carbazole polymer or polymer blend of a hole transport carbazole polymer with a film forming binder.

U.S. Pat. No. 4,784,928, the disclosure of which is totally incorporated herein by reference, discloses a reusable electrophotographic element comprising first and second charge transport layers. The second charge transport layer contains irregularly shaped fluorotelomer particles, an electrically nonconductive substance, dispersed in a binder resin. The second charge transport layer allows for toner to be uniformly transferred to a contiguous receiver element with minimal image defects.

Layered imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine, dispersed in a polycarbonate binder as a hole transport layer. The above components, such as the photogenerating compounds and the aryl amine charge transport, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments, which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent; and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

SUMMARY

Disclosed are imaging members with many of the advantages illustrated herein, such as extended lifetimes of service of, for example, in excess of about 1,000,000 imaging cycles; excellent electronic characteristics; stable electrical properties; low image ghosting; resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or with no change over a number of imaging cycles as illustrated by the generation of known PIDCs (Photo-Induced Discharge Curve), and the like.

Also disclosed are layered imaging members which are responsive to near infrared radiation of from about 700 to about 900 nanometers; layered flexible photoresponsive imaging members with sensitivity to visible light; layered belt photoresponsive or photoconductive imaging members with mechanically robust and solvent resistant charge transport layers; and flexible imaging or photoconductor members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

In an electrostatographic reproducing apparatus for which the photoconductors of the present disclosure can be selected, a light image of an original to be copied is recorded in the form of an electrostatic latent image upon a photosensitive member, and the latent image is subsequently rendered visible by the application of electroscopic thermoplastic resin particles, which are commonly referred to as toner. Specifically, the photoreceptor is charged on its surface by means of an electrical charger to which a voltage has been supplied from a power supply. The photoreceptor is then imagewise exposed to light from an optical system or an image input apparatus, such as a laser and light emitting diode, to form an electrostatic latent image thereon. Generally, the electrostatic latent image is developed by a developer mixture of toner and carrier particles. Development can be accomplished by known processes, such as a magnetic brush, powder cloud, highly agitated zone development, or other known development process.

After the toner particles have been deposited on the photoconductive surface in image configuration, they are transferred to a copy sheet by a transfer means, which can be pressure transfer or electrostatic transfer. In embodiments, the developed image can be transferred to an intermediate transfer member, and subsequently transferred to a copy sheet.

When the transfer of the developed image is completed, a copy sheet advances to the fusing station with fusing and pressure rolls, wherein the developed image is fused to a copy sheet by passing the copy sheet between the fusing member and pressure member, thereby forming a permanent image. Fusing may be accomplished by other fusing members, such as a fusing belt in pressure contact with a pressure roller, fusing roller in contact with a pressure belt, or other like systems.

Aspects of the present disclosure relate to a drum or flexible imaging member comprising an optional supporting substrate, a photogenerating layer, and at least one charge transport layer comprised of at least one charge transport component, and thereover a layer comprised of a polymer, and wherein the charge transport layer contains an aryl amine, and more specifically, tetra(m-tolyl)biphenyidiamine also referred to as N,N,N',N'-tetra(4-methylphenyl)-(1,1'-biphenyl)-4,4'-diamine; a photoconductor wherein there is further included in said charge transport layer at least one of aryl amine molecules of the formula

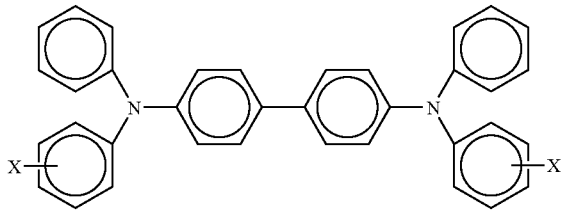

wherein X is selected from the group consisting of at least one of alkyl, alkoxy, aryl, and halogen; and aryl amine molecules of the formula

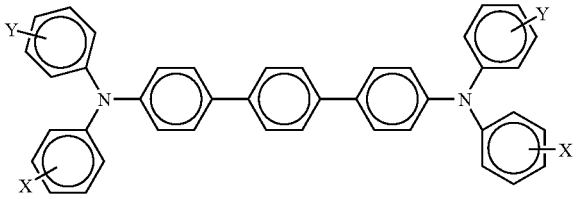

wherein X and Y are independently selected from the group consisting of at least one of alkyl, alkoxy, aryl, and halogen; and said at least one charge transport layer is from 1 to about 4; a photoconductor comprised in sequence of a supporting substrate, a photogenerating layer, a charge transport layer comprised of N,N,N',N'-tetra(4-methylphenyl)-(1,1'-biphenyl)-4,4'-diamine and a resin binder; and in contact with the charge transport layer a second layer comprised of a polymer or binder resin; and an imaging or photoconductor member comprising an optional supporting substrate, a photogenerating layer, at least one charge transport layer comprised of at least one charge transport component, and a layer in contact with the charge transport layer comprised of a suitable polymer, and wherein said charge transport layer comprises at least one component of the formula/structure

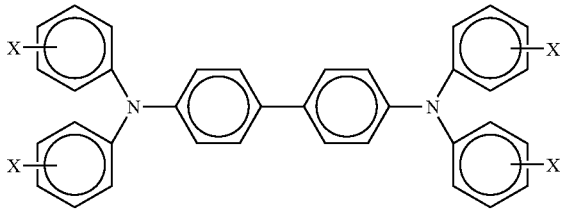

wherein X represents a suitable substituent like alkyl.

Generally, the charge transport layer is deposited on the photogenerating layer in a first pass followed by the deposition of the polymer containing layer in a second pass as, more specifically, illustrated herein.

More specifically, there is disclosed herein a photoconductor comprised of a supporting substrate, a hole blocking layer, an adhesive layer, a photogenerating layer, a first pass charge transport layer of a thickness, for example, of from about 1 to about 100 microns, from about 10 to about 50 microns, or from about 5 to about 25 microns, and which layer is comprised of hole transport molecules and a resin binder wherein the hole transport molecules are comprised of N,N,N',N'-tetra (4-methylphenyl)-(1,1'-biphenyl)-4,4'-diamine (tetra-methyl TBD(TM-TBD) or the corresponding alkyl diamines with from 2 to about 25 carbon atoms, and a second pass layer comprised of a polymer or resin binder, such as a polycarbonate, and which layer is of a thickness, for example, of from about 1 to about 100 microns, from about 10 to about 50 microns, or from about 5 to about 25 microns. The charge transport in embodiments can further comprise suitable additives, such as at least one additional binder polymer, such as from 1 to about 5 polymers, at least one additional hole transport molecule, such as from 1 to about 7, 1 to about 4, or from 1 to about 2 antioxidants like IRGANOX®, and the like. Additionally, the second pass polymer layer can include therein additional components inclusive of a plurality of polymers of from, for example, from 1 to about 5, from 1 to about 3, or from 1 to about 2 polymers. Although not being desired to be limited by theory, it is believed that there results some intermixing of the components in the top charge transport layer with the second pass polymer layer thereby generating a concentration gradient of the charge transport molecules in the charge transport layer similar to what is disclosed in copending application U.S. application Ser. No. 11/257,668 (US Patent Application Publication 2007/0092817, the disclosure of which is totally incorporated herein by reference, and wherein there is recited a method for forming an imaging member comprising (a) providing a layer comprising a charge transport material; and, (b) depositing a flowable, high viscosity overcoat composition over the layer comprising the charge transport material. Therefore, in embodiments of the present disclosure the surface of the aforementioned layers will be substantially free of transport molecules while intermixing between the two layers will result in a concentration gradient across the interface of the two layers, that is the bottom of the charge transport layer, which entire layer is, for example, of a thickness of from about 1 to about 100 microns, from about 10 to about 50 microns, and more specifically, from about 5 to about 25 microns, will contain the highest concentration of charge transport molecule, and the top of the polymer layer deposited on the charge transport, which entire layer is, for example, of a thickness of from 1 to about 100 microns, from about 10 to about 50 microns, and more specifically, from about 5 to about 25 microns, will contain the lowest concentration of charge transport molecule.

In embodiments, the intermixing of the charge transport layer components and the polymer containing layer components thereover results in a concentration gradient with the gradient amounts of charge transporting components or hole transport molecules being dependant on a number of factors, such as the viscosity of the polymer layer solution, the thicknesses of each of these layers, amount of charge transport components, and the like. Generally, the amount of charge transport components ranges from the lower amount being present on the surface of the photoconductor, that is for example, on the surface of the top generated polymer layer with the highest concentration of charge transport components deposited in a first pass present at the bottom of the charge transport layer. Thus, for example, when the thickness of the first pass charge transport layer and second pass polymer layer thereover are each 15 microns, and the first pass charge transport layer contains about 50 weight percent of charge transport material, the estimated charge transport concentrations within the gradient are for the bottom of the charge transport layer in contact with the photogenerating layer from about 30 to about 50 weight percent of charge transport material; the top layer polymer layer surface contains from about zero (0) to about 20 weight percent of charge transport material; and the layer, or middle of the intermixed region situated between the bottom of the charge transport layer and the top of the polymer containing layer contains from about 20 to about 40 weight percent of charge transport material or component.

The thickness of the photoconductor substrate layer depends on many factors, including economical considerations, electrical characteristics, and the like, thus this layer may be of substantial thickness, for example over 3,000 microns, such as from about 300 to about 1,000 microns, or of a minimum thickness. In embodiments, the thickness of this layer is from about 75 microns to about 300 microns, or from about 100 microns to about 150 microns.

The substrate, which may be opaque or substantially transparent, may comprise a number of suitable materials, inclusive of known photoconductor supporting substrate, and wherein the substrate is usually in contact with and contiguous to the photogenerating layer. Accordingly, the substrate may comprise a layer of an electrically nonconductive or conductive material such as an inorganic or an organic composition. As electrically nonconducting materials, there may be selected a number of various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, as disclosed in a copending application referenced herein, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials, commercially available as MAKROLON®5705.

The photogenerating layer in embodiments is comprised of, for example, about 60 weight percent of Type V hydroxygallium phthalocyanine or chlorogallium phthalocyanine, and about 40 weight percent of a resin binder like poly(vinyl chloride-co-vinyl acetate)copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed, in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin is present in various suitable amounts, for example from about 1 to about 50, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates; copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating may comprise amorphous films of selenium and alloys of selenium and arsenic, tellurium, germanium, and the like, hydrogenated amorphous silicon, and compounds of silicon and germanium, carbon, oxygen, nitrogen and the like fabricated by vacuum evaporation or deposition. The photogenerating layers may also comprise inorganic pigments of crystalline selenium and its alloys; Group II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines can be selected as photogenerating materials or pigments, especially when the photoconductor is incorporated in laser printers using infrared exposure systems. Infrared sensitivity is usually desired for photoreceptors exposed to low-cost semiconductor laser diode light exposure devices. The absorption spectrum and photosensitivity of the phthalocyanines depend on the central metal atom of the compound. Many metal phthalocyanines have been reported that are suitable, such as oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal free phthalocyanine.

In embodiments, examples of polymeric binder materials that can be selected for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride, and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The photogenerating composition or pigment is present in the resinous binder composition in various suitable amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 minutes to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer and a charge transport layer or plurality of charge transport layers are formed on the photogenerating layer. This structure may have the photogenerating layer on top of or below the charge transport layer.

In embodiments, a suitable adhesive layer can be included in the photoconductor. Typical adhesive layer materials are, for example, polyesters, polyurethanes, copolyesters, polyamides, poly(vinyl butyral), poly(vinyl alcohol), polyurethanes, polyacrylonitriles, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Borden Chemical).

Additional components can be included in the at least one charge transport layer, such as aryl amines, which layer generally is of a thickness of from about 5 microns to about 75 microns, and more specifically, of a thickness of from about 10 microns to about 40 microns of the following formula

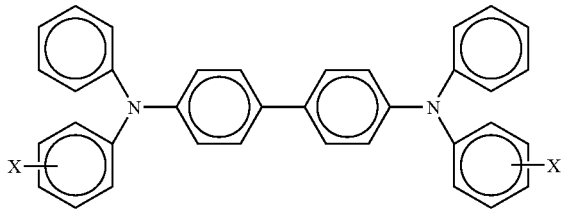

wherein each X is as illustrated herein. Alkyl contains, for example, from 1 to about 25 carbon atoms, and more specifically, from 1 to about 12 carbon atoms, such as methyl, ethyl, propyl, butyl, pentyl, and the like. A specific example of a charge transport molecule encompassed by the above formula is a tetra[m-tolyl] biphenyldiamine also referred to as N,N,N',N'-tetra(4-methylphenyl)-(1,1'-biphenyl)-4,4'-diamine.

Moreover, in embodiments there can be further included in the charge transport layer in effective amounts of, for example, from about 10 to about 90 weight percent, or from about 25 to about 75 weight percent, a number of known charge transport molecules (inclusive of those of the above formula wherein each X is a suitable hydrocarbon like alkyl, alkoxy, aryl, and substituted derivatives thereof, halogen or mixtures thereof), such as aryl amines of, for example, N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine; pyrazolines such as 1-phenyl-3-(4'-diethylamino styryl)-5-(4"-diethylamino phenyl)pyrazoline; terephenyl amines such as N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N '-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. Other additional known charge transport layer molecules can be selected, reference for example U.S. Pat. Nos. 4,921,773 and 4,464,450, the disclosures of which are totally incorporated herein by reference.

Examples of the binder materials selected for the charge transport layer include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, may comprise the charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. In embodiments, charge transport refers, for example, to charge transporting molecules as a monomer that allows the free charge generated in the photogenerating layer to be transported across the transport layer.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The polymer top layer usually deposited on the uppermost charge transport layer is comprised of a number of suitable components and a resin binder. Examples of polymers selected for the top layer are in embodiments the same as or similar to the polymer binders selected for the charge transport layer. Specific examples of polymers included in the top layer are polycarbonates, polystyrenes, polyarylates, polyesters, polyimides, polysiloxanes, polysulfones, polyphenyl sulfides, polyetherimides, polyphenylene vinylenes, mixtures thereof, and the like. Examples of polycarbonate polymers include, but are not limited to, LEXAN™ polymers, available from the General Electric Company, and MAKROLON® polymers, available from Bayer, having a molecular weight of from about 30,000 to about 500,000.

Examples solvents selected for the polymer layer include, but are not limited to, a number of solvents, such as alkylene halides, especially alkylene chlorides like methylene chloride; halobenzenes like monochlorobenzene; tetrahydrofuran (THF); toluene; dioxolane, xylene; 1,2-dichloroethane; chloroform; methylethylketone; methybutylketone, and the like. The solvent in the polymer layer solution is present in various effective amounts, such as for example, from about 80 to about 96 weight percent wherein the total of all components is about 100 weight percent. After the polymer layer is deposited on top of the transport layer, the solvent is removed by heating such that the polymer layer contains, for example, less than about 1 weight percent solvent after drying.

In embodiments, there are disclosed imaging members or photoconductors comprised of a photogenerating layer that contains at least one photogenerating pigment, such as from 1 to about 7, from 1 to about 4, or a mixture thereof, present in an amount of from about 5 to about 95 weight percent; a member wherein the thickness of the photogenerating layer is from about 0.1 to about 4 microns, wherein the photogenerating layer contains a polymer binder, and wherein the binder is present in an amount of from about 50 to about 90 percent by weight, and wherein the total of the photogenerating layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein the charge transport resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a photoconductor wherein the photogenerating pigment is Type V titanyl phthalocyanine; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; an imaging apparatus containing a charging component, a development component, a transfer component, and a fixing component; and wherein the apparatus contains a photoconductive imaging member comprised of a supporting substrate, and thereover a layer comprised of photogenerating pigments, and a plurality of charge transport layers; a member wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating pigment amount is from about 0.05 weight percent to about 20 weight percent, and wherein the photogenerating pigment is optionally dispersed in from about 10 weight percent to about 80 weight percent of a polymer binder; a member wherein the thickness of the photogenerating layer is from about 1 to about 12 microns; a member wherein the photogenerating and charge transport layer components are contained in a polymer binder; a member wherein the binder is present in an amount of from about 50 to about 90 percent by weight, and wherein the total of the layer components is about 100 percent; an imaging member wherein the conductive substrate is aluminum or aluminized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating component is Type V hydroxygallium phthalocyanine, or chlorogallium phthalocyanine, and the charge transport layer contains a hole transport of N,N,N',N'-tetra(4-methylphenyl)-(1,1'-biphenyl)-4,4'-diamine(tetra-methyl TBD(TM-TBD); and further can contain N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; photoconductive imaging members comprised of a supporting substrate, a photogenerating layer, a hole transport layer, and a top overcoating layer in contact with the hole transport layer or in embodiments in contact with the photogenerating layer, and in embodiments wherein a plurality of charge transport layers are selected, such as for example from two to about ten, and more specifically two, may be selected; and a photoconductive imaging member comprised of an optional supporting substrate, a photogenerating layer, and a first, second, and third charge transport layer.

Examples of components or materials optionally incorporated into the charge transport layer to, for example, enable improved lateral charge migration (LCM) resistance include hindered phenolic antioxidants, such as tetrakis methylene(3,5-di-tert-butyl-4-hydroxy hydrocinnamate)methane (IRGANOX 1010™ available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40 AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

At least one, especially as it is applicable to the charge transport layer, refers, for example, to 1; to from 1 to about 7; from 1 to about 4; from 1 to about 3, and yet more specifically, to 2 layers.

Primarily for purposes of brevity, the examples of each of the components/compounds/molecules, polymers, (components) for each of the layers, specifically disclosed herein are not intended to be exhaustive. Thus, a number of components, polymers, formulas, structures, and group or substituent examples and carbon chain lengths not specifically disclosed or claimed are intended to be encompassed by the present disclosure and claims. Similarly, the values or numbers include all values therebetween the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

EXAMPLE I

Imaging devices or photoconductors were prepared as follows. A machine coated metallized MYLAR® substrate was provided, and a HOGaPc/Type V poly(bisphenol-Z carbonate) photogenerating layer was machine coated over the substrate. A charge transport layer was hand coated on the above photogenerating layer. The charge transport solution was prepared by mixing 5 grams of N,N,N',N'-tetra(4-methylphenyl)-(1,1'-biphenyl)-4,4"-diamine hole transport molecule, and 5 grams of MAKROLON® 5705 in 60 grams of methylene chloride in a bottle by stirring until all solids dissolved. The charge transport layer was coated on the photogenerating layer using a web coating method, and by drawing a 5 inch 8-path applicator with a 5 mil gap across the device to deposit a charge transport layer having a thickness of about 15 micrometers. The charge transport coating was dried in a forced air oven for about 1 minute at about 120° C.

A polymer layer was then hand coated over the above charge transport layer. The polymer solution was prepared by mixing 5 grams of MAKROLON® 5705 and 65 grams of methylene chloride in a bottle by stirring until all the solids dissolved. The polymer layer was coated on the charge transport layer using a web coating method, and by drawing a 3.5 inch 8-path applicator with a 5 mil gap across the device to deposit a polymer layer having a thickness of about 15 micrometers. The coating was dried in a forced air oven for about 1 minute at about 20° C.

A control or comparative photoconductor was prepared as follows. A metallized MYLAR® substrate was provided, and a HOGaPc/poly(bisphenol-Z carbonate) photogenerating layer was machine coated over the substrate. A charge transport layer was then hand coated on the photogenerating layer. The charge transport solution was prepared by mixing 5 grams of N,N'-diphenyl-N,N'-bis(3-methylphenyl)-1,1'-biphenyl-4,4'-diamine (TPD), hole transport molecules, and 5 grams of MAKROLON® 5705 in 60 grams of methylene chloride in a bottle by stirring until all solids dissolved. The charge transport layer was coated using a web coating method, and by drawing a 5 inch 8-path applicator with a 10 mil gap across the device to deposit a charge transport layer having a thickness of about 30 micrometers. The coating was dried in a forced air oven for about 1 minute at about 120° C.

Electrical Evaluation:

The xerographic electrical properties of the above prepared imaging member with the 2-pass CTL (charge transport layer) configuration containing N,N,N',N'-tetra(4-methylphenyl)-(1,1'-biphenyl)-4,4'-diamine in the first pass and MAKROLON® 5705 in the second pass, and two control comparative photoconductors prepared as indicated above, were determined by electrostatically charging their surfaces with a corona discharging device, in the dark, until the surface potential attained an initial value $V_{ddp}$ of about 700 volts, as measured 100 milliseconds later by a capacitively coupled probe attached to an electrometer. The charged members were then exposed to light (785 nanometers, 200 milliseconds after charging) from a filtered xenon lamp. A reduction in the surface potential to $V_{bg}$ background potential due to photodischarge effect was observed 100 milliseconds following exposure. Photodischarge characteristics were represented by $E_{1/2}$ and $E_{7/8}$ values. $E_{1/2}$ was the exposure energy required to achieve a photodischarge from $V_{ddp}$ to ½ of $V_{ddp}$ and $E_{7/8}$ the energy for a discharge from $V_{ddp}$ to ⅛ of $V_{ddp}$. The light energy used to photodischarge the photoconductors during the exposure step was measured with a light meter. The higher the photosensitivity, the smaller were the $E_{1/2}$ and $E_{7/8}$ values. Residual potential after erase Vr was measured after the devices were further subjected to a high intensity white light irradiation from a secondary filtered xenon lamp. The cyclic stability of the devices was assessed by performing repetitive charging and discharging over 10,000 cycles. The changes in Vr were monitored by subtracting the initial voltages at 100 cycles from the final voltages of the last cycle. The smaller the changes, the better was the cyclic stability, another important attribute for a functional device.

As illustrated in Table 1, the imaging member above with the 2-pass CTL configuration containing N,N,N',N'-tetra(4-methylphenyl)-(1,1'-biphenyl)-4,4'-diamine in the first pass, and MAKROLON® 5705 in the second pass exhibited electrical properties comparable to the comparative control photoconductors. Also, as illustrated in Table 1, the 2-pass imaging member showed no cycling up of residual voltage after 10,000 cycles while the control photoconductors indicated 21 volt and 18 volt cycle up after 10,000 cycles, respectively.

TABLE 1

| Sample | $E_{1/2}$ [ergs/cm$^2$] | $E_{7/8}$ [ergs/cm$^2$] | $Vr_o$ [volts] | $Vr_{10k}$ [volts] | Vr [$Vr_{10K} - Vr_o$] [volts] |
|---|---|---|---|---|---|
| Control Sample 1 | 1.0 | 3.3 | 35 | 56 | 21 |
| Control Sample 2 | 1.0 | 2.8 | 35 | 53 | 18 |
| 2-Pass | 1.0 | 2.2 | 45 | 37 | −8 |

Two-pass CTL configuration with N,N,N',N'-tetra(4-methylphenyl)-(1,1'-biphenyl)-4,4'-diamine in the first pass, and MAKROLON® 5705 in the second pass showed similar electricals and improved cycling stability compared to the control photoconductors.

Deletion Resistance:

Deletion resistance was evaluated by a lateral charge migration (LCM) print testing scheme. The above prepared hand coated photoconductor devices were cut into 6 inch×1 inch strips. One end of the strip from the respective devices was cleaned using a solvent to expose the metallic conductive layer on the substrate. The conductivity of the exposed metallic conductive layer was then measured to ensure that the metal had not been removed during cleaning. The conductivity of the exposed metallic conductive layer was measured using a multimeter to measure the resistance across the exposed metal layer (around 1 KOhm). A fully operational 85 millimeter DC12, a Xerox Corporation standard DOCUCOLOR®, photoreceptor drum was prepared to expose a lengthwise strip of bare aluminum (0.5 inch×12 inch) to provide the ground for the hand coated device when it is operated. The cleaning blade was removed from the drum housing to prevent it from removing the hand coated devices during operation.

The hand coated imaging member with the 2-pass CTL configuration with N,N,N',N'-tetra(4-methylphenyl)-(1,1'-biphenyl)-4,4'-diamine in the first pass and MAKROLON® 5705 in the second pass, and the control devices were then mounted onto a drum using conductive copper tape to adhere the exposed conductive end of the devices to the exposed aluminum strip on the drum to complete a conductive path to the ground. After mounting the devices, the device-to-drum conductivity was measured using a standard multimeter in a resistance mode. The resistance between the respective devices and the drum should be similar to the resistance of the conductive coating on the respective hand coated devices. The ends of the devices were then secured to the drum using SCOTCH™ tape, and all exposed conductive surfaces were covered with SCOTCH™ tape. Up to seven photoconductor devices may be mounted, side by side, on one drum. The drum was then placed in a Xerox Corporation DOCUCOLOR® 12 (DC12) machine and a template containing 1 bit, 2 bit, 3 bit, 4 bit, and 5 bit lines was printed. The machine settings (developer bias, laser power, grid bias.) were adjusted to obtain visible prints that resolved the 5 individual lines above. If the 1 bit line is barely showing, then the settings are saved and the print becomes the reference, or the pre-exposure print. The drum was removed and placed in charge-discharge apparatus which generates corona discharge during its operation. The drum was charged and discharged (cycled) for 650,000 cycles to induce deletion (LCM). The drum was then removed from the apparatus and placed in the DC12 machine, and the template was printed again.

The imaging member with the 2-pass CTL configuration with N,N,N',N'-tetra(4-methylphenyl)-(1,1'-biphenyl)-4,4'-diamine in the first pass and MAKROLON® 5705 in the second pass showed a high level of deletion resistance after 650,000 cycles. The 1 bit, 2 bit, 3 bit, 4 bit, and 5 bit lines were all visible when printed. The control photoconductors showed a much lower level of deletion resistance after 650,000 cycles; the 1 bit and 2 bit lines did not print, while the 3 bit, 4 bit, and 5 bit lines did print.

Stress Cracking:

Stress cracking was evaluated as follows. The imaging member with the 2-pass CTL configuration with N,N,N',N'-tetra(4-methylphenyl)-(1,1'-biphenyl)-4,4'-diamine in the first pass and MAKROLON® 5705 in the second pass, and the control comparative photoconductors were evaluated. The devices were cut into 19 inch×1 inch strips. The devices were then mounted onto a tri-roller stress tester and rotated at about 60 rpm for 10,000 cycles, which mimiced mechanical stress that photoreceptor belts undergo during operation inside conventional printers. The devices were removed from the tri-roller and one end of the strip was cleaned using solvent to expose the metallic conductive layer on the substrate. The conductivity of the exposed metallic TiZr substrate layer was then measured to ensure that the metal had not been removed during cleaning. The resistance across the exposed metal layer was measured using a multimeter (about 1 KOhm).

An 85 millimeter Xerox Corporation DOCUCOLOR® 12 (DC12) photoreceptor drum was prepared according to Example I to expose a lengthwise 0.5 inch×12 inch strip of bare aluminum. This provided the ground for the imaging member with the 2-pass CTL configuration with N,N,N',N'-tetra(4-methylphenyl)-(1,1'-biphenyl)-4,4'-diamine in the first pass and MAKROLON® 5705 in the second pass when in operation. The control comparative photoconductors were similarly prepared. The cleaning blade was also removed from the drum housing to prevent it from removing the hand coated devices during operation. The hand coated devices were mounted on the 85 millimeter Xerox Corporation DOCUCOLOR® 12 (DC12) drum using conductive copper tape to adhere the exposed conductive end of the respective devices to the exposed aluminum strip on the drum to complete the conductive path to the ground. Once mounted, the device-to-drum conductivity was measured using a standard multimeter in resistance mode. The resistance between the devices and the drum should be similar to the resistance of the conductive coating on the hand coated device. Once the conductivity was determined to be high enough, the ends of the respective devices were secured using SCOTCH™ tape such that all exposed ends were covered with SCOTCH™ tape. The drum was then placed in the DC12 machine and a blank print was made (white background). The machine settings were adjusted to generate clean prints showing dark marks where small cracks had formed in the CTL layer of the 2-pass control devices.

The imaging member employing the 2-pass CTL configuration with N,N,N',N'-tetra(4-methylphenyl)-(1,1'-biphenyl)-4,4'-diamine in the first pass and MAKROLON® 5705 in the second pass showed no printable cracks after 10,000 cycles on the tri-roller. The control devices with a single pass containing N,N'-diphenyl-N,N'-bis(3-methylphenyl)-1,1'-biphenyl-4,4'-diamine (TPD) showed severe cracking after 10,000 cycles.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An imaging member consisting essentially of a supporting substrate; a photogenerating layer; at least one charge transport layer comprised of at least one charge transport component and a polymer binder; and a polymer layer in contact with the charge transport layer comprised of a polymer selected from the group consisting of at least one of polycarbonates, polystyrenes, polyarylates, polyesters, polyimides, polysiloxanes, polysulfones, polyphenyl sulfides, polyetherimides, and polyphenylene vinylenes, and wherein said charge transport layer comprises at least one component of the formula/structure

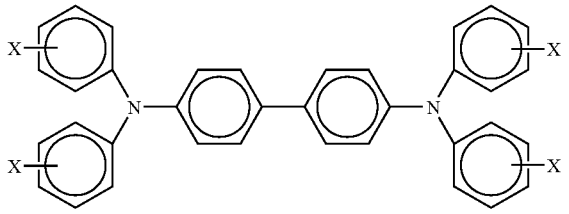

wherein X represents alkyl; wherein said at least one charge transport layer is 1, 2, or 3 layers, and wherein said charge transport layer and said polymer layer are intermixed resulting in the presence of the charge transport component in a gradient concentration from the highest concentration in the bottom of the charge transport layer in a direction that the lowest concentration is on the surface of the polymer layer, and wherein said gradient comprises from about 5 to about 15 percent by weight of said charge transport component on the surface of said polymer layer; from about 25 to about 35 percent by weight of said charge transport component in an intermixed region between said polymer layer and said charge transport layer; and from about 40 to about 50 percent by weight of said charge transport component at the bottom of said charge transport layer; and wherein the concentration gradient is accomplished by diffusing of the charge transport component from the charge transport layer to the polymer layer.

2. An imaging member in accordance with claim 1 wherein said alkyl contains from 1 to about 12 carbon atoms.

3. An imaging member in accordance with claim 1 wherein said alkyl is at least one of methyl, ethyl, propyl, and butyl, and wherein said supporting substrate is in contact with and contiguous to said photogenerating layer.

4. An imaging member in accordance with claim 1 wherein said component is N,N,N',N'-tetra(4-methylphenyl)-(1,1'-biphenyl)-4,4'-diamine.

5. An imaging member in accordance with claim 1 wherein said component is N,N,N',N'-tetra(4-methylphenyl)-(1,1'-biphenyl)-4,4'-diamine, the thickness of said charge transport layer is from 1 to about 100 microns, and wherein said supporting substrate is in contact with and contiguous to said photogenerating layer.

6. An imaging member in accordance with claim 1 wherein said component is N,N,N',N'-tetra(4- methylphenyl)-(1,1'-biphenyl)-4,4'-diamine, the thickness of said charge transport layer is from about 10 to about 50 microns, and said at least one charge transport is comprised of from 1 to 2 layers.

7. An imaging member in accordance with claim 1 wherein said component is N,N,N',N'-tetra(4-methylphenyl)-(1,1'-biphenyl)-4,4'-diamine, and the thickness of said charge transport layer is from about 5 to about 50 microns.

8. An imaging member in accordance with claim 1 wherein said polymer layer is comprised of said polycarbonate.

9. An imaging member in accordance with claim 1 wherein said photogenerating layer is comprised of at least one photogenerating pigment.

10. An imaging member in accordance with claim 9 wherein said photogenerating pigment is comprised of at least one of a metal phthalocyanine, a metal free phthalocyanine, a titanyl phthalocyanine, a halogallium phthalocyanine, a perylene, or mixtures thereof.

11. An imaging member in accordance with claim 9 wherein said photogenerating pigment is comprised of a Type V titanyl phthalocyanine.

12. An imaging member in accordance with claim 9 wherein said photogenerating pigment is comprised of at least one of a chlorogallium phthalocyanine, and a hydroxygallium phthalocyanine.

13. An imaging member in accordance with claim 1 further including a hole blocking layer and an adhesive layer, and wherein said supporting substrate is in contact with and contiguous to said photogenerating layer.

14. A photoconductor comprised in sequence of a supporting substrate, a photogenerating layer, a charge transport layer and a polymer layer in contact with the charge transport layer, and wherein said charge transport layer is comprised of molecules of N, N,N',N'-tetra(4-methylphenyl)-(1,1'-biphenyl)-4,4'-diamine, and a resin binder; wherein said polymer is selected from the group consisting of at least one of poly (bisphenol-A carbonate), poly(bisphenol-Z carbonate), and poly(bisphenol-A carbonate)-co-poly(bisphenol-Z carbonate); wherein said charge transport layer and said polymer layer are intermixed resulting in the presence of the charge transport component in a gradient concentration from the highest concentration in the bottom of the charge transport layer in a direction that the lowest concentration is on the surface of the polymer layer; wherein said gradient comprises from about zero (0) to about 20 percent by weight of said charge transport component on the surface of said polymer layer; from about 20 to about 40 percent by weight of said charge transport component in an intermixed region between said polymer layer and said charge transport layer; and from about 30 to about 50 percent by weight of said charge transport component at the bottom of said charge transport layer; and wherein the concentration gradient is accomplished by diffusing of the charge transport component from the charge transport layer to the polymer layer.

15. A photoconductor in accordance with claim 14 wherein said photogenerating layer is comprised of a titanyl phthalocyanine, a halogallium phthalocyanine, a hydroxygallium phthalocyanine, a perylene, or mixtures thereof, and wherein said gradient comprises from about 5 to about 15 percent by weight of said charge transport component on the surface of said polymer layer; from about 25 to about 35 percent by weight of said charge transport component in an intermixed region between said polymer layer and said charge transport layer; and from about 40 to about 50 percent by weight of said charge transport component at the bottom of said charge transport layer; and wherein said polymer is selected from the group consisting of at least one of poly(bisphenol-A carbonate), and poly(bisphenol-Z carbonate).

16. A photoconductor in accordance with claim 1 wherein said polymer is selected from the group consisting of at least one of poly(bisphenol-A carbonate), poly(bisphenol-Z carbonate), and poly(bisphenol-A carbonate)-co-poly(bisphenol-Z carbonate).

17. A photoconductor in accordance with claim 1 wherein said intermixed region of said charge transport component and said polymer has a thickness from about 25 to about 50 microns.

18. A photoconductor in accordance with claim 1 wherein said charge transport layer further includes an antioxidant.

19. A photoconductor in accordance with claim 1 wherein said substrate is rigid or flexible.

20. A photoconductor comprised of a photogenerating layer, at least one charge transport layer, and a layer in contact with the charge transport layer comprised of a polymer selected from the group consisting of at least one of a polycarbonate, a polystyrene, a polyarylate, a polyester, a polyimide, a polysiloxane, a polysulfone, a polyphenyl sulfide, a polyetherimide, and a polyphenylene vinylene, and wherein said charge transport layer comprises

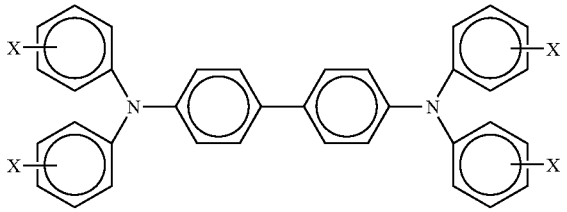

wherein X represents alkyl with from 1 to about 6 carbon atoms, wherein said charge transport layer and said polymer layer are intermixed resulting in the presence of the charge transport component in a gradient concentration from the highest concentration in the bottom of the charge transport layer in a direction that the lowest concentration is on the surface of the polymer layer, and wherein said gradient comprises from about zero (0) to about 20 percent by weight of said charge transport component on the surface of said polymer layer; from about 20 to about 40 percent by weight of said charge transport component in an intermixed region between said polymer layer and said charge transport layer; and from about 30 to about 50 percent by weight of said charge transport component at the bottom of said charge transport layer; and wherein the concentration gradient is accomplished by diffusing of the charge transport component from the charge transport layer to the polymer layer.

21. A photoconductor in accordance with claim 20 wherein said alkyl is methyl, and said at least one is from 1 to about 4.

22. A photoconductor in accordance with claim 20 wherein each of said Xs comprises methyl groups in the para positions, and said at least one charge transport layer comprises from 1 to about 4 layers.

23. A photoconductor in accordance with claim 20 wherein said polymer is selected from the group consisting of at least one of poly(bisphenol-A carbonate), poly(bisphenol-Z carbonate), and poly(bisphenol-A carbonate)-co-poly(bisphenol-Z carbonate).

24. A photoconductor in accordance with claim 20 wherein said charge transport component is N,N,N',N'-tetra(4-methylphenyl)-(1,1'-biphenyl)-4,4'-diamine.

* * * * *